US006616236B1

(12) United States Patent
Su

(10) Patent No.: US 6,616,236 B1
(45) Date of Patent: Sep. 9, 2003

(54) ADJUSTABLE HEADREST DEVICE

(76) Inventor: Tung-Hua Su, No. 6, Sec. 3, Bao Ta Road, Kuwi Jen Hsiang, Tainan Hsien (TW)

( * ) Notice: Subject to any disclaimer, the term of this patent is extended or adjusted under 35 U.S.C. 154(b) by 0 days.

(21) Appl. No.: 10/318,534

(22) Filed: Dec. 14, 2002

(51) Int. Cl.[7] ..... A47C 7/36
(52) U.S. Cl. ..... 297/410; 297/409; 297/353; 248/118
(58) Field of Search ..... 297/353, 410, 297/409, 383; 248/118

(56) References Cited

U.S. PATENT DOCUMENTS 2,666,476 A * 1/1954 Lycan ..... 297/410 X
3,692,356 A * 9/1972 Mertens ..... 297/408
4,451,084 A * 5/1984 Seeley ..... 297/353
5,308,028 A * 5/1994 Kornberg ..... 248/118

* cited by examiner

*Primary Examiner*—Anthony D. Barfield
(74) *Attorney, Agent, or Firm*—Charles E. Baxley

(57) ABSTRACT

An adjustable headrest device includes a fixed base fixed to a backrest of a chair, a movable seat mounted to the fixed base and slidable along a vertical direction of the fixed base, a headrest attaching device mounted to the movable seat and slidable along a front/rear direction of the movable seat, and a headrest fixed to the headrest attaching device to move therewith. The movable seat is retainable in a desired level relative to the fixed base, and the headrest is retainable in a desired front/rear position relative to the movable base.

5 Claims, 6 Drawing Sheets

ADJUSTABLE HEADREST DEVICE

BACKGROUND OF THE INVENTION

1. Field of the Invention

The present invention relates to an adjustable headrest device that allows a user to adjust a vertical position and a front/rear position of a headrest of a chair.

2. Description of the Related Art

A headrest is mounted on top of the backrest of a chair for supporting the head of the person sitting in the chair. The headrest is fixed in most designs and thus could not be adjusted. Adjustable headrests have been proposed to allow a user to adjust a vertical position of the headrest according to the height of the user, yet the front/rear position of the headrest is still not adjustable. Further, the headrest may have undesired movement if not properly positioned after adjustment.

SUMMARY OF THE INVENTION

An object of the present invention is to provide an adjustable headrest device that allows a user to adjust a vertical position and a front/rear position of a headrest of a chair.

Another object of the present invention is to provide an adjustable headrest device that can reliably retain the headrest in place after adjustment.

An adjustable headrest device in accordance with the present invention includes a fixed base fixed to a backrest of a chair, a movable seat mounted to the fixed base and slidable along a vertical direction of the fixed base, a headrest attaching means mounted to the movable seat and slidable along a front/rear direction of the movable seat, and a headrest fixed to the headrest attaching means to move therewith. The movable seat is retainable in a desired level relative to the fixed base, and the headrest is retainable in a desired front/rear position relative to the movable base.

Other objects, advantages, and novel features of the invention will become more apparent from the following detailed description when taken in conjunction with the accompanying drawings.

DETAILED DESCRIPTION OF THE PREFERRED EMBODIMENT

Hereinafter, the adjustable headrest device according to the embodiment of the invention will be explained with reference to FIGS. 1 through 6. As used herein, terms such as "upward," "downward," "front," and "rear," will be construed with respect to the direction viewed by the user sitting in the chair with the adjustable headrest device in accordance with the present invention. Such terms are used merely for convenience, and are not intended in a limiting sense.

Figure 1:
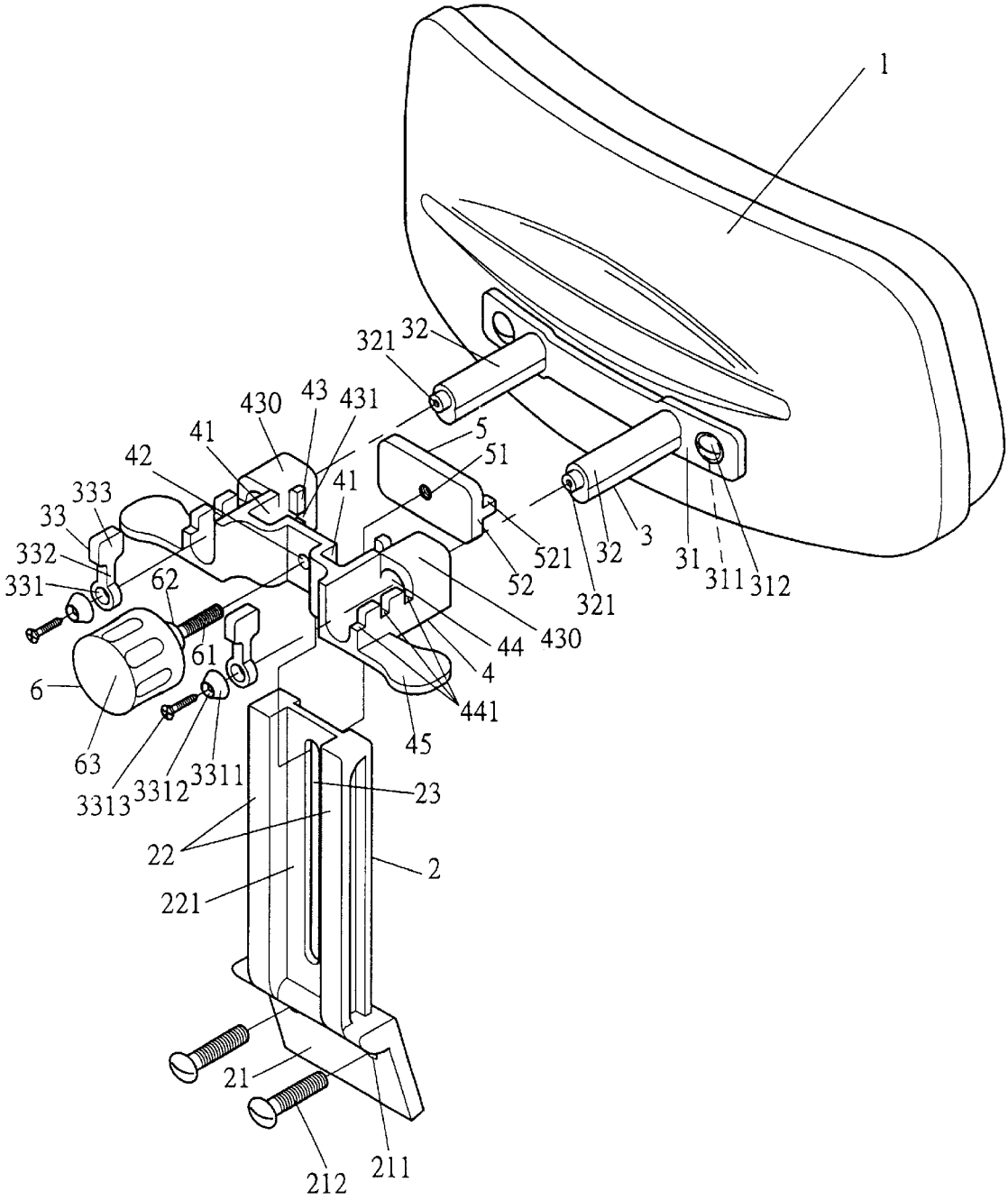
FIG. 1 is an exploded perspective view of an adjustable headrest device in accordance with the present invention.
Figure 2:
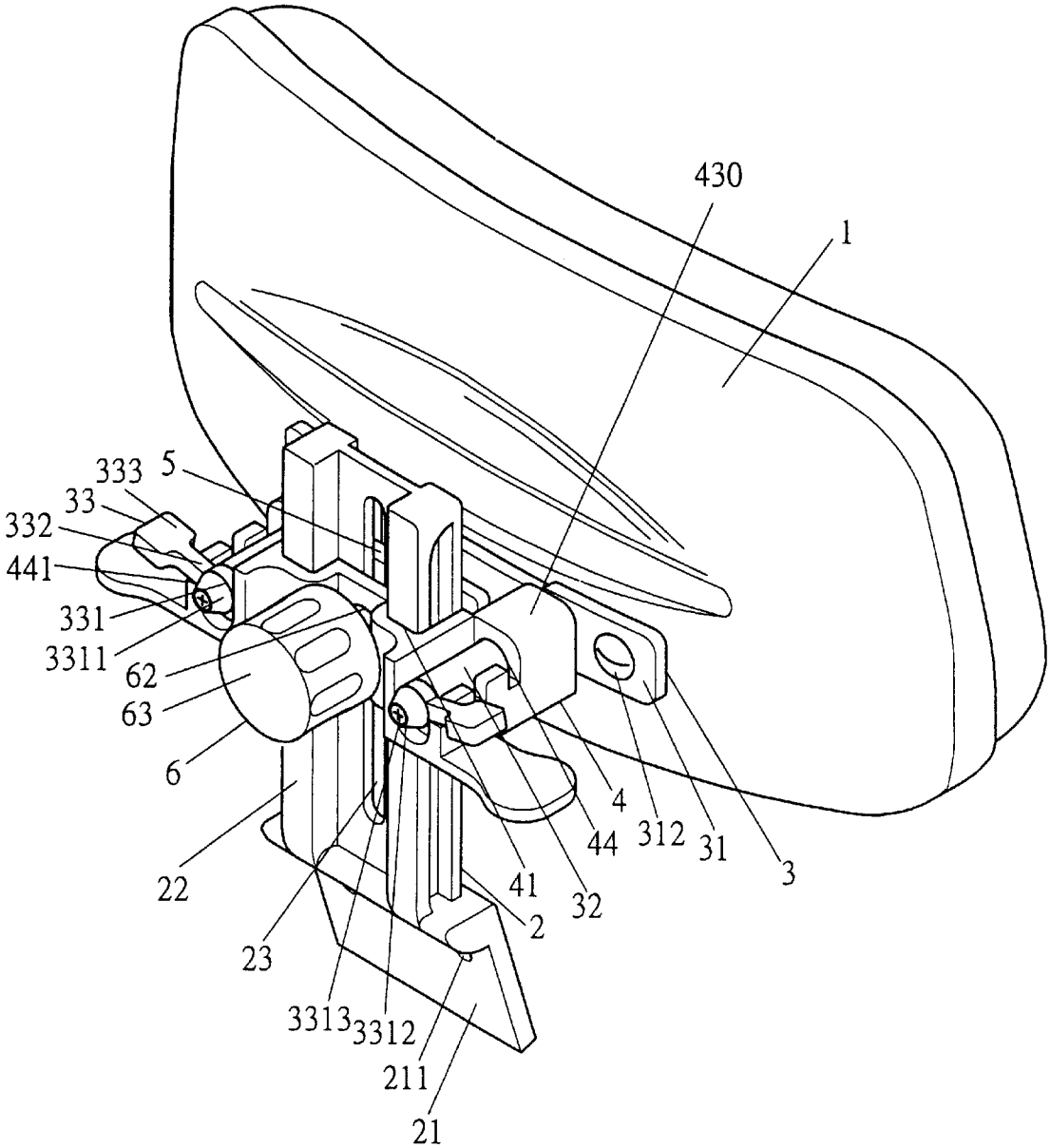
FIG. 2 is a perspective view of the adjustable headrest device in accordance with the present invention.
Figure 3:
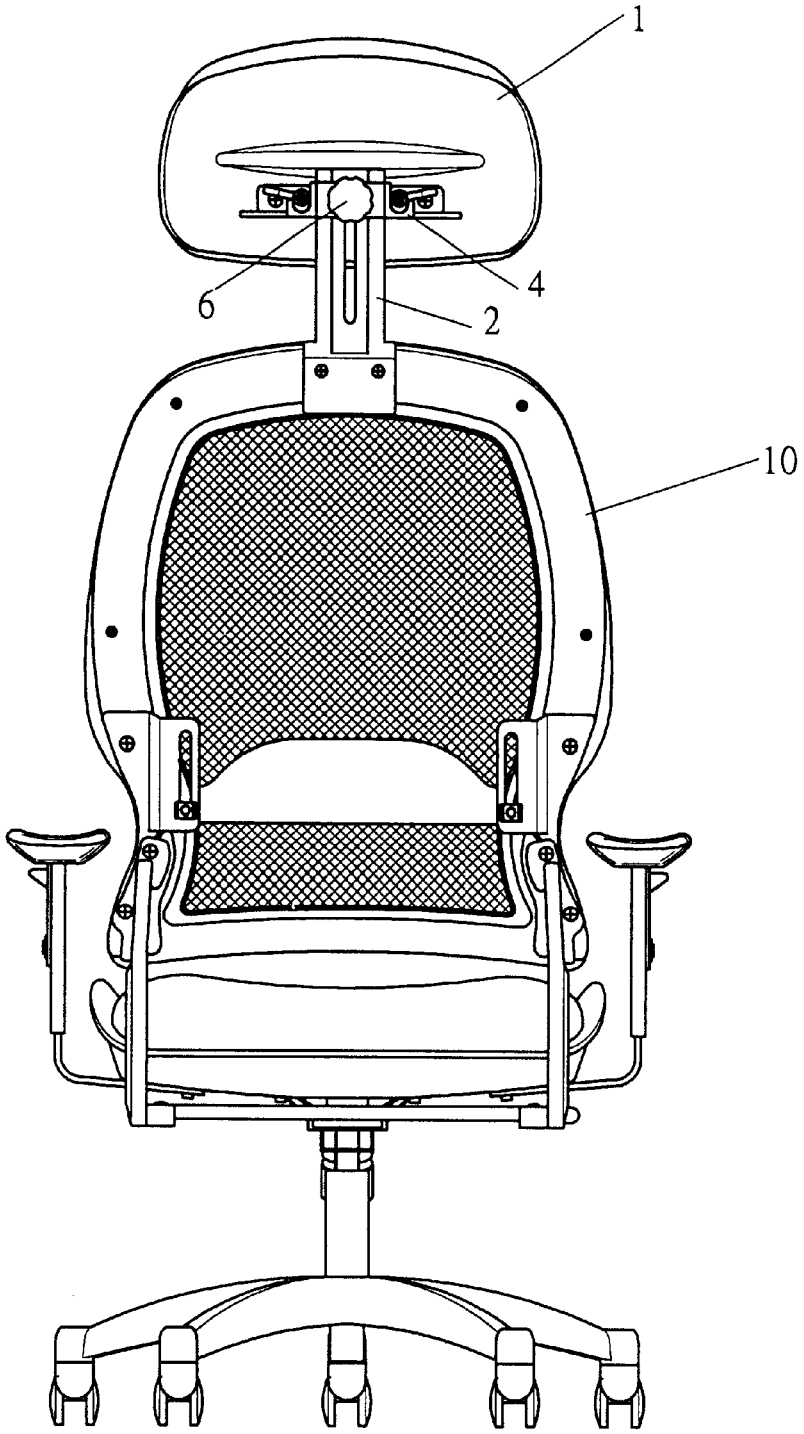
FIG. 3 is a rear view of a chair with the adjustable headrest device in accordance with the present invention.

Referring to FIGS. 1 through 3, the adjustable headrest device in accordance with the present invention generally comprises a headrest 1, a fixed base 2, a headrest attaching means 3, a movable base 4, a pressing plate 5, and a knob 6.

The fixed base 2 is fixed on top of a backrest 10 of a chair by means of extending fasteners 212 through fixing holes 211 in a lower end thereof. The fixed base 2 includes two spaced vertical walls 22 and a connecting wall 221 between the vertical walls 22. A vertical slot 23 is defined in the connecting wall 221.

The headrest attaching means 3 includes a pair of engaging posts 32 fixed to the headrest 1. In this embodiment, a plate 31 is fixed to a rear side of the headrest 1 be means of extending screws 312 through fixing holes 311 of the plate 31, and the engaging posts 32 extend rearward from the plate 31. Each engaging post 32 has a screw hole 321 in a distal end thereof. Two positioning members 33 are provided and each includes a first end 331 pivotally connected to the distal end of an associated engaging post 32, a second 333 for manual operation, and an intermediate portion 332. A resilient pressing cap 3331 is mounted to the first end 331 of each positioning member 33 and has a central through-hole 3312.

The movable base 4 includes a pair of vertical grooves 42 for respectively slidingly receiving the vertical walls 22 of the fixed base 2. The movable base 4 includes a hole 42 aligned with the vertical slot 23 of the fixed base 2. The movable base 4 further includes a pair of side walls 430 each having an inner face on which a rib 43 and an engaging slot 431 are formed. Each side wall 430 of the movable base 4 includes an insertion hole 44 through which an associated one of the engaging post 32 extends. Each side wall 430 of the movable base 4 further includes a plurality of positioning notches 441 spaced along a front/rear direction and communicating with an associated insertion hole 44.

The pressing plate 5 is made of a material with appropriate resiliency and friction and includes a central screw hole 51 and two inserts 521 that are inserted into the engaging slots 431 of the movable base 4. The pressing plate 5 is restrained by the ribs 43 on the movable base 4.

The knob 6 includes a threaded stem 61, a pressing portion 62 formed on an end of the threaded stem 62, and an enlarged head 63 behind the pressing portion 62. The pressing portion 62 is a solid portion having a diameter greater than a width of the vertical slot 23 of the fixed base 2.

In assembly, the fixed seat 2 is fixed to the backrest 10 by fasteners 212, and the headrest attaching means 3 is fixed to the headrest 1 by screws 312. The vertical grooves 41 of the movable base 4 are engaged with the vertical walls 22 of the fixed base 2, and the two inserts 521 of the pressing plate 5 are inserted into the engaging slots 431 of the movable base 4. The stem 61 of the knob 6 is extended through the hole 42 of the movable base 4, the vertical slot 23 of the fixed base 2, and the screw hole 51 of the pressing plate 5. The engaging posts 32 are inserted into the insertion holes 44 of the movable base 4. The first end 331 of each positioning member 33 is pivotally connected to an associated engaging post 32 by extending a fastener 3313 through the central through-hole 3312 of an associated pressing cap 3311, a hole (not labeled) in the first end 331 of the positioning member 33, and the screw hole 321 of an associated engaging post 32. Thus, each positioning member 33 can be retained in either a vertical position or a horizontal position when the respective fastener 3313 is tightened.

Figure 4:
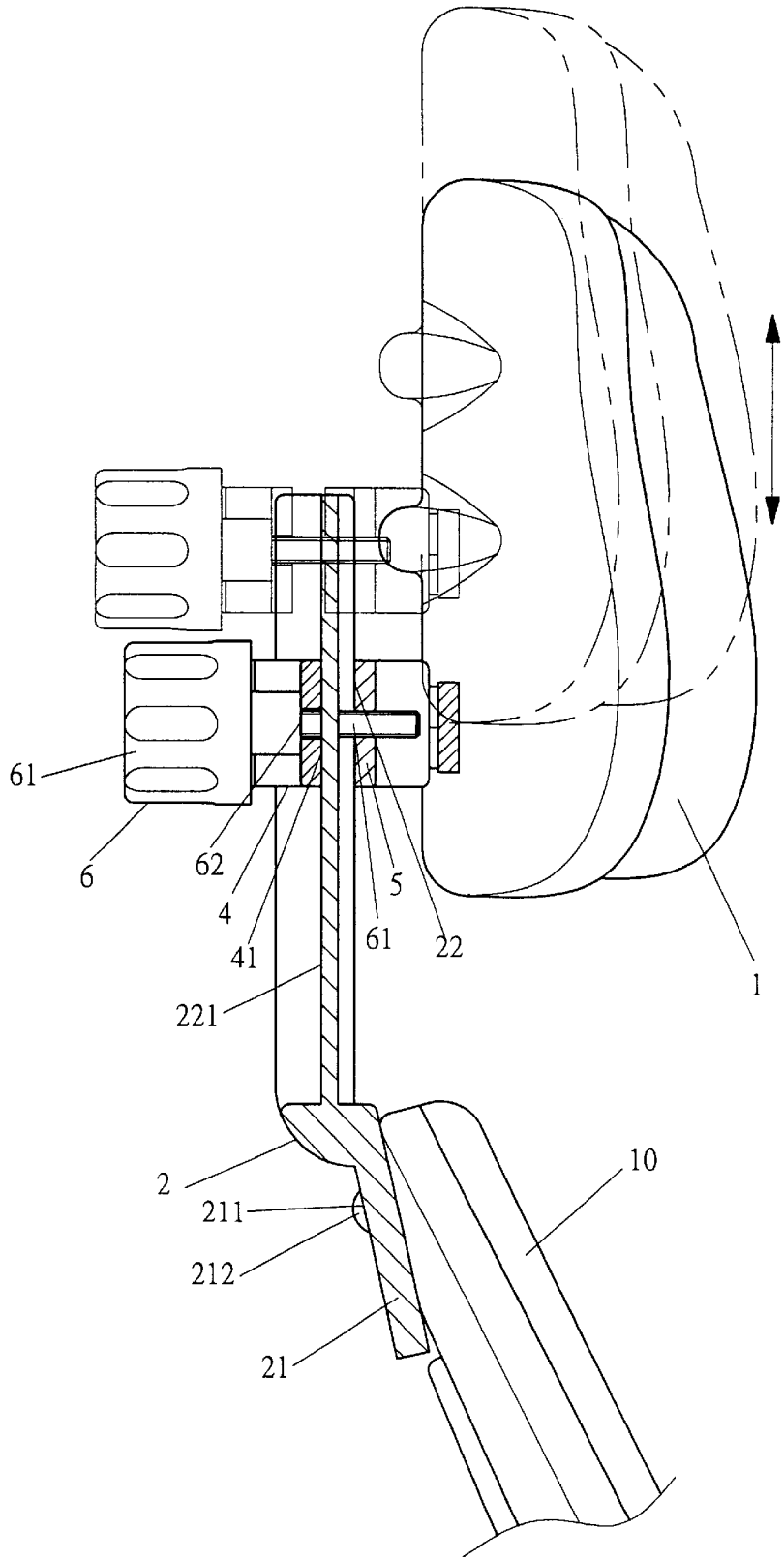
FIG. 4 is a sectional view illustrating adjustment of the headrest in a vertical direction.

Referring to FIG. 4, when adjusting the height of the headrest 1, the knob 6 is loosened, and the movable base 4 is moved vertically until the headrest 1 reaches a desired level. Vertical movement of the movable base 4 relative to the fixed base 2 is allowed, as the vertical walls 22 of the fixed base 2 are respectively slidingly received in the vertical grooves 41 of the movable base 4. When the headrest 1 reaches the desired level, the knob 6 is tightened through manual rotation, the pressing portion 62 on the knob 6 and the pressing plate 5 together clamp two sides of the bottom wall 221 of the fixed base 2, thereby retaining the headrest 1 in the desired level.

Figure 5:
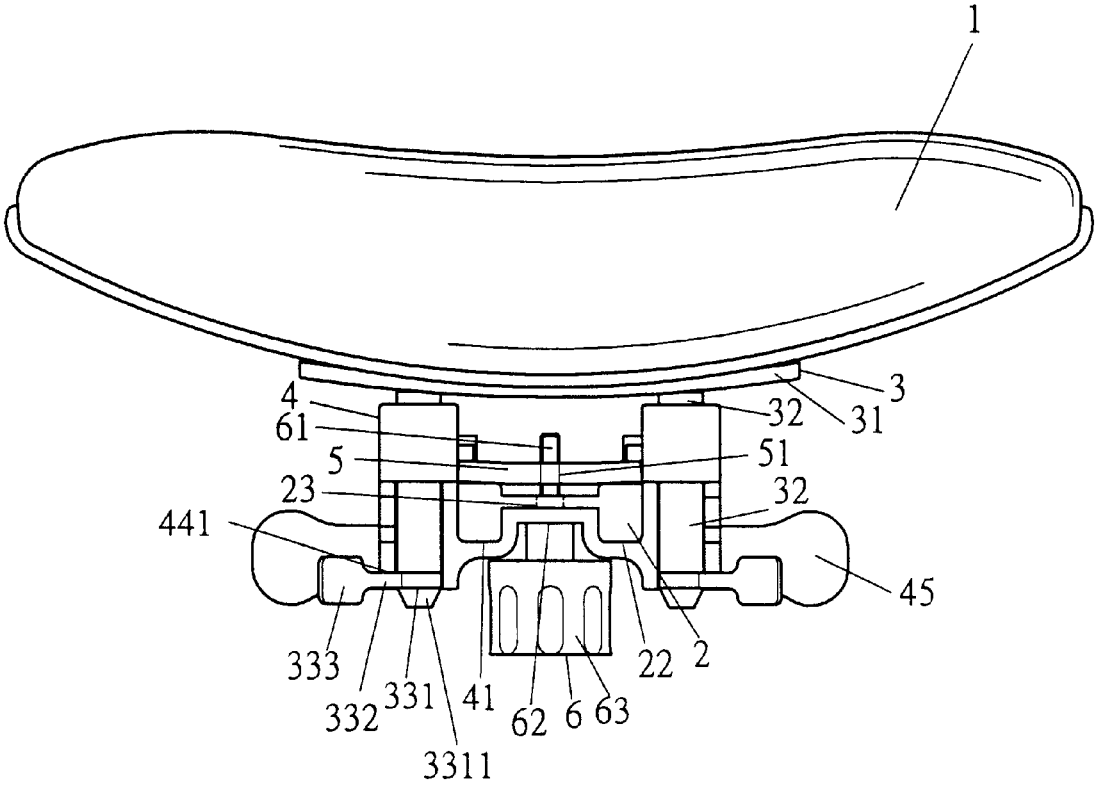
FIG. 5 is a top view of the adjustable headrest device in accordance with the present invention.
Figure 6:
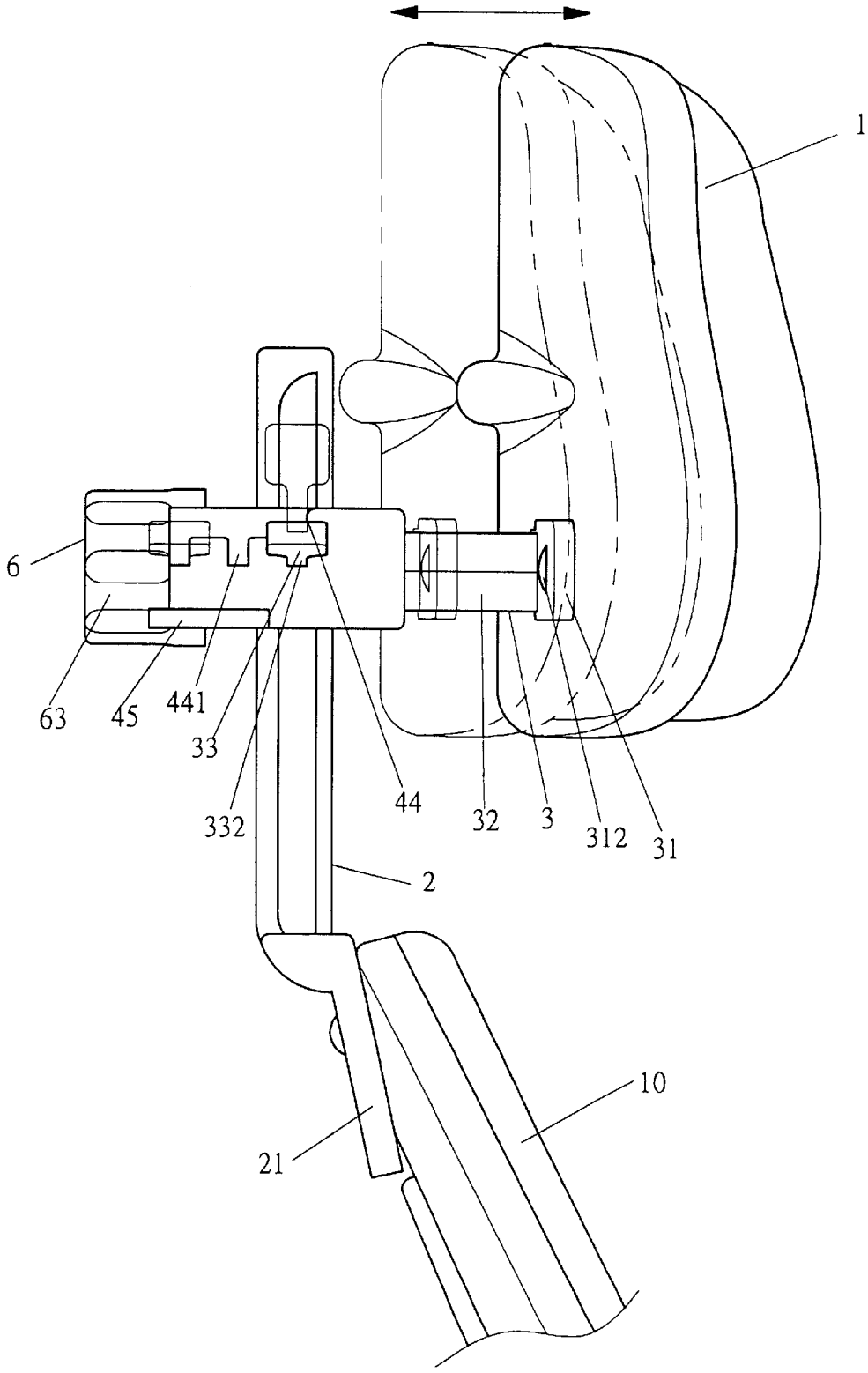
FIG. 6 is a view similar to FIG. 4, illustrating adjustment of the headrest in a front/rear direction.

Referring to FIGS. 5 and 6, when adjusting the position of the headrest 1 in the front/rear direction, each positioning member 33 is pivoted from a horizontal position to a vertical position by means of gripping the second end 333 of each positioning member 33 and then pivoting each positioning member 33. The intermediate portion 332 of each positioning member 33 is disengaged from the positioning notches 441 of the movable base 4. The headrest 1 is moved forward or rearward to a desired position, as shown in FIG. 6. Next, each positioning member 33 is pivoted from the vertical position to the horizontal position until the intermediate portion 332 of each positioning member 33 is inserted into an associated one of the positioning notches 441 of the movable base 4.

According to the above description, it is appreciated that the headrest device in accordance with the present invention can be adjusted in the vertical position as well as the front/rear position. And the headrest can be reliably retained in place after adjustment.

Although the invention has been explained in relation to its preferred embodiment, it is to be understood that many other possible modifications and variations can be made without departing from the scope of the invention as hereinafter claimed.

What is claimed is:

1. An adjustable headrest device, comprising:

a fixed base adapted to be fixed to a backrest of a chair;

a movable seat mounted to the fixed base and slidable along a vertical direction of the fixed base;

a headrest attaching means mounted to the movable seat and slidable along a front/rear direction of the movable seat; and a headrest fixed to the headrest attaching means to move therewith;

with the movable seat being retainable in a desired level relative to the fixed base; and with the headrest being retainable in a desired front/rear position relative to the moveable seat, wherein the fixed base includes two spaced vertical walls and a connecting wall between the vertical walls, the movable base including two vertical grooves in which the vertical walls of the fixed base are respectively, slidingly received.

2. The adjustable headrest device as claimed in claim 1, wherein the connecting wall of the fixed base includes a vertical slot, the movable base including a hole aligned with the vertical slot of the fixed base, the movable base further including two side walls each having an insertion groove, the headrest attaching means includes two engaging posts extending rearward from the headrest and respectively slidingly extending through the insertion groove of an associated one of the side walls of the movable base, a pressing plate being attached to the movable base and having a screw hole, a knob including a threaded stem and an enlarged head on an end of the threaded stem for manual operation, the threaded stem of the knob being extended through the hole of the moveable base, the vertical slot of the fixed base, and the screw hole of the pressing plate, with the connecting wall of the fixed base being sandwiched between the enlarged head of the knob and the pressing plate.

3. The adjustable device as claimed in claim 2, wherein each said side wall of the movable base includes a plurality of positioning notches spaced along a front/rear direction and communicated with an associated one of the insertion holes, each said engaging post having a screw hole in a distal end thereof, two positioning members being provided and each having a first end pivotally connected to the distal end of an associated one of the engaging posts, a second end for manual pivotal operation, and an intermediate portion releasably engaged in one of the positioning notches.

4. The adjustable headrest device as claimed in claim 3, wherein the first end of each said positioning member has a hole, a resilient pressing cap being attached to the first end of each said positioning member and having a central through-hole, further including a fastener extending through the central through-hole of each pressing cap, the hole of the first end of each said positioning member, and the screw hole of an associated one of the engaging posts.

5. The adjustable device as claimed in claim 2, wherein each said side wall of the movable base includes an engaging slot, the pressing plate including two inserts respectively mounted in the engaging slots of the movable base.

* * * * *